United States Patent [19]

Garrett

[11] Patent Number: 4,541,211

[45] Date of Patent: Sep. 17, 1985

[54] INSULATED CONCRETE WALL

[75] Inventor: Dennis L. Garrett, Ft. Lauderdale, Fla.

[73] Assignee: International Housing Limited, Fort Lauderdale, Fla.

[21] Appl. No.: 477,371

[22] Filed: Mar. 21, 1983

[51] Int. Cl.[4] ..... E04C 2/04

[52] U.S. Cl. ..... 52/98; 52/309.12; 52/410; 52/405; 249/30; 249/83; 249/88; 249/219; 411/529

[58] Field of Search ..... 52/98, 309.12, 410, 52/405, 612; 249/38, 40, 41, 48, 46, 30, 83, 88, 219, 84, 85, 91, 117; 264/256, 333, 261, 271.1; 411/519, 518, 529, 520

[56] References Cited

U.S. PATENT DOCUMENTS

| | | | |
|---|---|---|---|
| 1,361,315 | 12/1920 | Dietrichs | 249/38 |
| 1,597,424 | 8/1926 | Bennetts | 249/219 R |
| 2,169,181 | 8/1939 | Kost | 411/520 |
| 2,251,723 | 8/1941 | Tinnerman | 411/529 |
| 2,442,962 | 6/1948 | Rumble | 249/38 |
| 2,754,717 | 7/1956 | Becker | 411/520 |
| 3,401,494 | 9/1968 | Anderson | 52/309.2 |
| 3,798,710 | 3/1974 | Tinnerman | 411/529 |
| 3,985,329 | 10/1976 | Liedgens | 249/40 |
| 4,329,821 | 5/1982 | Long | 249/38 |

*Primary Examiner*—Henry E. Raduazo

*Attorney, Agent, or Firm*—Blakely, Sokoloff, Taylor & Zafman

[57] ABSTRACT

An insulated concrete wall having a centrally disposed layer of insulation and utilizing a unitary means for simultaneously maintaining form panels in a predetermined spaced relationship, and for maintaining the insulation in a predetermined spaced relationship between the form panels such that a permanent and reinforced mechanical connection is provided between said concrete walls and said interposed insulation.

6 Claims, 4 Drawing Figures

INSULATED CONCRETE WALL

DISCLOSURE OF PRIOR ART

The following is a list of the prior art patents uncovered by Applicant with respect to the present application:

| Inventor | U.S. Pat. No. | Filed |
|---|---|---|
| W. Kleitz | 1,958,049 | April 23, 1930 |
| R. C. Graef | 2,063,309 | June 11, 1935 |
| B. Novambere | 2,086,571 | March 26, 1935 |
| R. D. Woodworth | 2,213,355 | December 21, 1939 |
| H. B. Hawes | 2,280,647 | December 16, 1940 |
| E. W. Nicholson | 2,347,276 | May 11, 1942 |
| G. W. Baker et al | 2,370,769 | June 15, 1942 |
| P. J. Callan | 2,595,123 | January 21, 1949 |
| P. J. Callan | 2,653,469 | June 12, 1948 |
| S. B. Roberts | 2,691,292 | July 7, 1949 |
| J. L. Bracewell | 2,612,674 | September 12, 1947 |
| C. Tillery | 2,634,601 | September 9, 1949 |
| C. B. Jones | 2,718,138 | December 9, 1948 |
| D. E. Meehan | 2,964,821 | July 5, 1956 |
| R. J. Sullivan | 3,129,481 | April 3, 1962 |
| W. Muhm | 3,295,278 | April 3, 1963 |
| K. Guddal | 3,353,322 | August 27, 1963 |
| R. C. Koch | 3,438,161 | July 15, 1965 |
| S. W. Shelley | 3,671,368 | December 24, 1970 |
| Haeussler | 3,757,482 | September 11, 1973 |
| Tenorio | 3,826,052 | July 30, 1974 |
| Egerborg et al | 3,828,504 | August 13, 1974 |
| Weismann | 3,879,908 | April 29, 1975 |
| Beer | 3,898,780 | August 12, 1975 |
| Lovisa et al | 3,927,857 | December 23, 1975 |
| Ickes | 3,943,676 | March 16, 1976 |
| Haeussler | 3,996,713 | December 14, 1976 |
| Steenson et al | 4,117,639 | October 3, 1978 |
| Nilsen et al | 4,149,349 | April 17, 1979 |
| Della-Donna | 4,157,638 | June 12, 1979 |
| Haeussler | 4,183,186 | January 15, 1980 |
| Artzer | 4,226,067 | October 7, 1980 |
| Fricker et al | 4,283,896 | August 18, 1981 |
| Mulvihill | 4,292,783 | October 6, 1981 |
| Long et al | 4,329,821 | May 18, 1982 |

BACKGROUND OF THE INVENTION

The present invention relates to an insulated concrete wall and method of fabricating such a wall where the same rods are used as both form ties for maintaining form panels a preselected distance apart, and as tie rods for interconnecting the insulation layer with the concrete wall layers.

The use of prefabricated forms for fabricating concrete walls is well known in the art. For example, Stout, U.S. Pat. No. 3,307,822, discloses the use of straps as cross ties for positioning and maintaining opposite form panels together while the wall is being formed. Further, Long, U.S. Pat. No. 4,329,821, discloses an insulated concrete wall incorporating tie rods to hold essentially disposed insulation board between adjacent concrete wall layers and to provide a strong mechanical connection such layers.

However, in certain applications, particularly where skilled labor may be unavailable and walls must be fabricated quickly, the use of separate tie rods and form ties is inefficient because they must be installed in separate steps in the wall fabrication process.

SUMMARY OF THE INVENTION

In an exemplary embodiment of the invention, an insulated concrete wall and method of construction is provided incorporating a unitary means for simultaneously maintaining form panels in a predetermined spaced relationship, and for fixedly maintaining the insulation layer in a predetermined spaced relationship between the form panels until the concrete cures and the form panels are removed. The insulated concrete wall includes a plurality of rods extending perpendicularly through slots defined in the insulation layer and further extending through the pour-formed concrete wall layers and at least some distance beyond the outer surface thereof. The ends of the rods are adapted to engage receiving slots in the form panels for securing the rods thereto. Retainer clips are mounted on the rods and engage each side of the insulation board such that the board is fixed in place and the rods can not be removed. Thus, the rods provide a unitary means for laterally supporting the forms in a predetermined parallel spaced relationship, for maintaining the insulation layer in a predetermined parallel spaced relationship between the forms, and for providing a permanent and rigid mechanical connection between the concrete wall layers and the interposed insulation layer.

Other objects and many attendant advantages of the invention will become more apparent upon a reading of the following description together with drawings in which like reference numerals refer to like parts throughout.

DETAILED DESCRIPTION OF THE INVENTION

Figure 1:
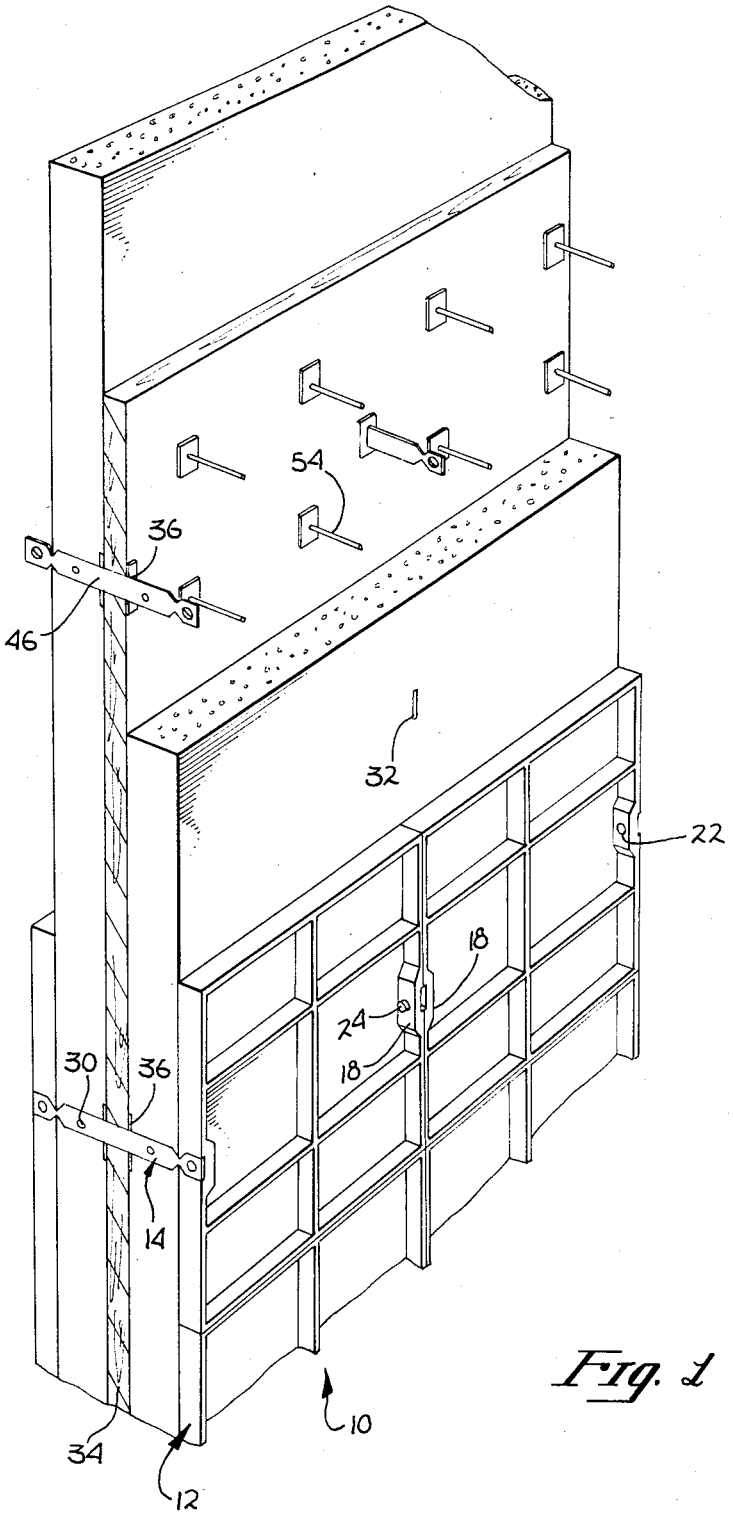
FIG. 1 is a perspective view of the insulated concrete wall of the present invention shown disposed between form panels and broken out across various sections.

Referring now to FIG. 1, the insulated concrete wall system 10 of the present invention is shown. Opposing parallel form panels 12 serve as supports for pouring and forming an insulated concrete wall. The form panels 12 are maintained at a predetermined distance apart with a plurality of rods for forming a wall of a desired thickness.

Figure 4:
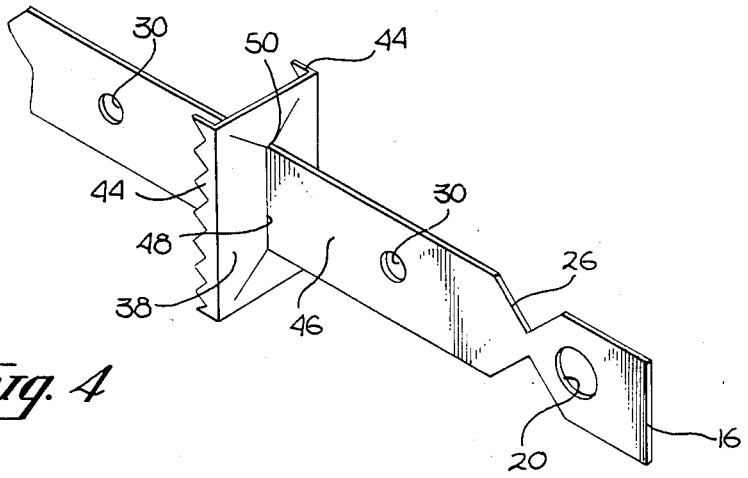
FIG. 4 is a perspective view showing the retainer clip mounted on the rod of the present invention.

As illustrated most clearly in FIG. 4, the rods 14 have a rectangular cross section 16 of narrow transverse width, and are made of a resilient plastic or other suitable resilient material. Thus, the rods may be easily stamped or extruded thereby minimizing manufacturing costs. Further, because the rods are substantially flat strips of material, they are easily stacked and boxed for shipment.

The rods 14 are adapted to be received by, and engage with, corresponding receiving slots 18 located along the edges of each form panel. The rods are provided with holes 20 which align with holes 22 in the receiving slots 18, and are secured therein by pins 24 or other suitable fastening means. The rods also include holes 30 for the locating and anchoring reinforcing steel.

Figure 2:
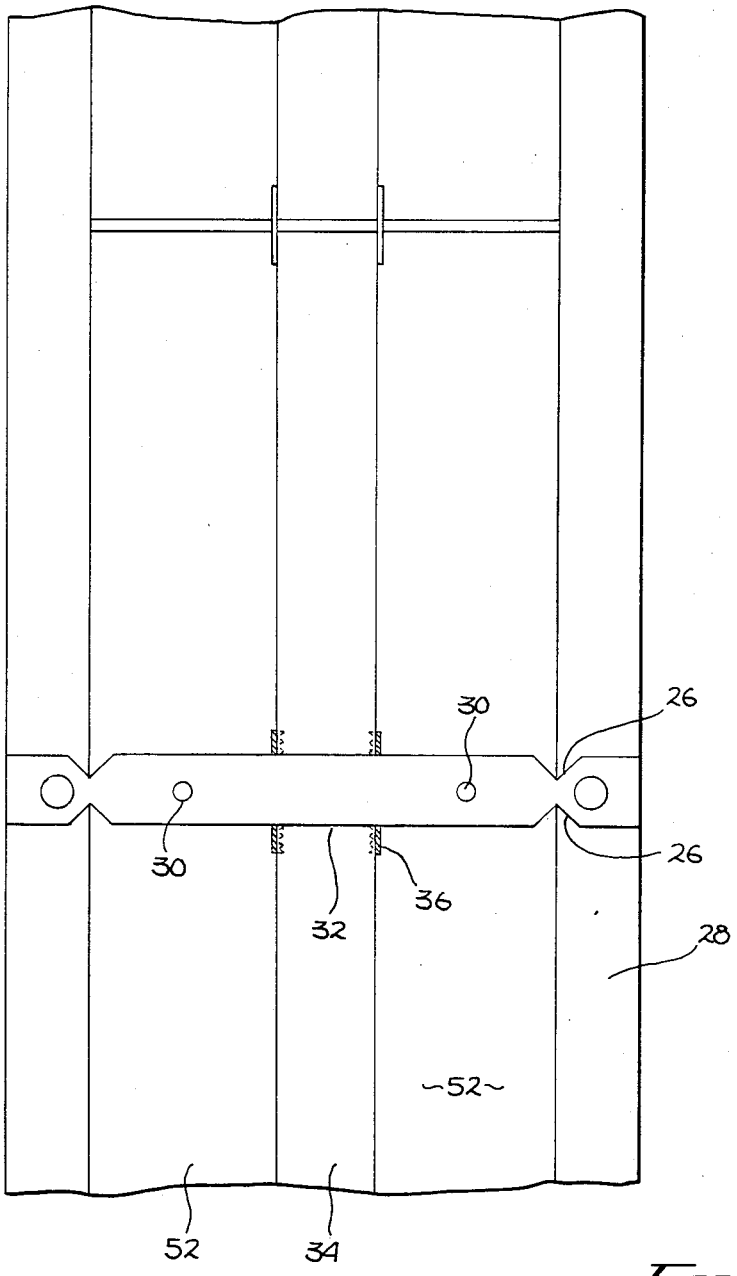
FIG. 2 is a side view of the insulated concrete wall of the present invention with form panels in place and detailing the structural configuration of the rods.
Figure 3:
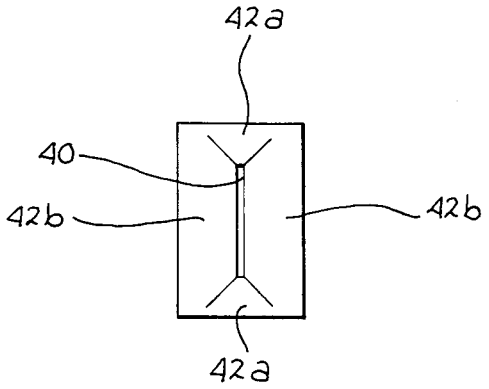
FIG. 3 is a plan view of the embodiment of the rectangular retainer clip utilizing flat spring flaps.

Referring now to FIGS. 2 and 3, the rods also have a pair of opposing V-shaped cut out portions 26 near each end of the rods which align with the concrete wall outer surfaces. These cut out portions substantially reduce the structural integrity of the rod along the reduced vertical dimension. Thus, when the forms 12 are removed after the poured concrete cures, the ends of the rods which protrude beyond the concrete wall surfaces can be easily snapped off such that the rod ends remain flush and align with the outer wall surfaces.

As shown in FIGS. 1 and 2, the rods 14 pass through slots 32 in the insulation board 34 which is disposed between and parallel to the form panels 12. Retainer clips 36 mounted on the rod retain the insulation board in a desired position between the forms 12 and prevent lateral movement of the insulation board along the rods.

As best seen in FIG. 4, the retainer clip 38 is a rectangular metal plate having a centrally disposed vertical slot 40 defined therethrough. Further, the retainer clip 36 has a pair of divergent cuts extending from either end of the slot thus forming two pairs of opposing flat spring flaps 42*a* and 42*b*. The retainer clip is also provided with a pair of integral sawtoothed vertical edges 44 which are perpendicular to the general plane of the retainer clip and when mounted on the rods, protrude inwardly toward the surface of the insulation as shown in FIG. 2. The unique geometry of the retainer clip enables it to slide easily along the rod in one direction for mounting. The sawtoothed edges 44 may then be pressed or otherwise urged into the surface of the insulation, thereby fixedly engaging the retainer clip.

The unique geometry of the rod and retainer clip is particularly well suited for securedly retaining the insulated wall in position. The four resilient flat spring flaps 42*a* and 42*b* prevent removal of the rods 14 after they are inserted in insulation board and also prevent lateral movement of the insulation board along the rod. The flat sides of the rod 46 enable the edges of the corresponding flat spring flaps 42*b* to engage with and firmly press against both sides of the rod 48 along its entire vertical dimension. Further, the upper and lower flat spring flaps 42*a* engage the rod along its upper and lower edges. Thus, if removal of the rod or movement of the insulation layer is attempted after the insulation layer is positioned and the rods and retainer clips are in place, the flat spring flaps will dig into the upper and lower edges of the rod, restraining movement. The use of a plastic rod enables the metal edges of the flat spring flaps to more easily engage with, and dig into, the rod if movement of the insulation layer or the rod is attempted. However, the rod may also be composed of other suitable resilient materials. Further, because the centrally disposed slot 40 and the cross section of the rod are both rectangular, flat spring flap engagement is accomplished along the entire cross-sectional perimeter of the rod, thereby maximizing the gripping and retaining capability of the retaining clip 38.

The rods and retainer clips provide spacing and support such that concrete can be poured to a desired wall thickness between the insulation layer and the adjacent form panels, and will be retained in a substantially fixed position between the form panels. Further, as the concrete cures, the rods provide a sturdy and rigid mechanical connection sandwiching the insulation layer 34 between the adjacent concrete wall layers 52, thereby forming a unitary insulated concrete wall structure.

Additional tie rods 54 may be inserted to retain the insulation board in a desired position between the forms and to further provide a rigid mechanical connection between the concrete wall layers and the insulation layer after concrete pouring.

The present insulated concrete wall lends itself to quick and relatively inexpensive fabrication particularly suited to environments where housing and commercial facilities must be built quickly and with minimal labor. To fabricate the insulated concrete wall of the present invention, rods 14 are first inserted through an insulation layer 34 having receiving slots 32 defined therethrough. The rods are aligned in the insulation layer such that it is disposed at a preselected distance between the form panels. Retainer clips 38 are then mounted onto both ends of the rods 14 and pressed or otherwise forceably engaged into the insulation layer surface. Thus, the sawtoothed edges 44 of the retainer clip penetrates the surface of the insulation layer and the retainer clips are maintained substantially flush with the insulation layer surface. The ends of the rods are then aligned with the receiving slots 18 of the form panels 12 such that the holes 20 at the ends of the rods 14 and the holes 22 through the slots on the form panels align. A 24 pin or other suitable fastening means is then inserted through the holes 20 and 22 securing the ends of the rods to the form panels and simultaneously securing adjacent form panels together. Additional independent spacer rods 54 may also be inserted through the insulation board and extending beyond the walls thereof for providing supplementing the strength of the mechanical interconnection between the concrete walls and the interposed insulation wall. Further, reinforcing rods may then be anchored to anchoring holes 30. Concrete is then poured into the spaces on either side of the insulation board between the form panels. After the concrete cures, the pins 24 are removed, along with the form panels. The protruding ends of the rods are then removed using a knock off tool or other suitable device, such that the rods remain flush and aligned with the exposed walls of the insulated concrete wall.

While the above description shows and describes a concrete insulated wall and construction method of one embodiment of the present invention, other embodiments may also be constructed. Thus, it will be understood that the same is capable of modification without departing from the spirit and scope of the invention defined in the claims.

I claim:

1. An insulated concrete wall including a unitary means for simultaneously maintaining form panels in a predetermined spaced relationship and fixedly maintaining concrete wall layers interleaved between insulation wall layers in a predetermined spaced relationship comprising:

a pair of pour formed concrete walls;

a layer of insulating material sandwiched therebetween having a plurality of rectangular receiving slots defined therethrough;

a plurality of rods extending perpendicularly through said rectangular receiving slots of said insulation material, through said pour formed concrete walls, and at least some distance beyond the outer surface of each said concrete wall;

said rods having a substantially narrow cross section, such that the planer sides of said rods are adapted to abut the sides of said rectangular receiving slots of said insulated wall, and of the forms that support said concrete wall during concrete pouring;

said planer sides of said rods being further adapted to be matably received through corresponding slots defined through said insulation, and to be received by receiving slots in said form panels;

a plurality retainer means mounted on said rods, each said retainer means comprising:

a resilient rectangular plate, said plate having a rectangular aperture defined therethrough and a pair of cuts defined therethrough directed divergently from each end of said aperative, thereby forming vertical and laterial resilient flat spring flaps for allowing insertion and positioning of said rods through said insulation but preventing removal of said rods once positioned;

a pair of sawtoothed edges extending perpendicularly from the edges of said rectangular plate for being press-engaged into said insulation board;

a pair of opposing cut out portions proximate to the ends of said rods to reduce the structural integrity of the rod along the reduced vertical dimension to facilitate failure thereof whereby the ends of said rod are easily snapped off after said forms are removed such that the ends of said rods remain flush and aligned with the outer surfaces of said concrete wall;

whereby said rods provide a unitary means to laterally support said forms and maintain said forms in a predetermined space relationship, and to simultaneously removably retain said insulation in a predetermined spaced relationship between said forms during concrete pouring wherein said rods provide both a permanent reinforcing means and an interconnecting means between said concrete walls and said insulation.

2. The rods as claimed in claim 1 further comprising apertures defined through each end thereof, such that said apertures align with corresponding apertures defined through receiving slots in said form panels, for receiving securing means for securing said ends of said rods to said form panels.

3. The rods as claimed in claim 2 further comprising apertures defined in said rods between said insulation and said forms for locating and anchoring reinforcing steel.

4. The insulated concrete wall as claimed in claim 2 wherein said securing means comprise locking pins.

5. The retainer means as claimed in claim 2 wherein said resilient plate comprises metal.

6. An insulated concrete wall as claimed in claim 2 wherein said material comprises a polymeric composition.

* * * * *